United States Patent [19]

Haas et al.

[11] 4,407,849

[45] Oct. 4, 1983

[54] PROCESS FOR IMPROVING ELECTRODE COATINGS

[75] Inventors: Laird K. S. Haas, Orefield; Larry H. Herring, Nazareth; Yoshinao Nakada, Emmaus, all of Pa.

[73] Assignee: Bell Telephone Laboratories, Incorporated, Murray Hill, N.J.

[21] Appl. No.: 333,974

[22] Filed: Dec. 23, 1981

[51] Int. Cl.[3] ..... B05D 5/12

[52] U.S. Cl. ..... 427/37; 427/58; 427/122; 427/331; 427/444; 361/120; 264/22; 264/26; 264/27

[58] Field of Search ..... 427/37, 58, 122, 331, 427/444; 29/25.14; 361/120; 264/22, 26, 27

[56] References Cited

U.S. PATENT DOCUMENTS

| | | | |
|---|---|---|---|
| 2,525,263 | 10/1950 | Macksoud | 427/37 |
| 2,887,413 | 5/1959 | Ekkers et al. | 427/37 |
| 3,454,811 | 7/1969 | Scudner, Jr. | 313/220 |
| 3,720,499 | 3/1974 | Hirayama et al. | 427/37 |
| 3,898,533 | 8/1975 | Scudner | 317/61 |
| 3,958,154 | 5/1976 | Hill et al. | 361/120 |
| 4,037,266 | 7/1977 | English et al. | 361/120 |
| 4,175,277 | 11/1979 | Zuk | 361/120 |

FOREIGN PATENT DOCUMENTS

| | | | |
|---|---|---|---|
| 828336 | 2/1960 | United Kingdom | 427/37 |

OTHER PUBLICATIONS

Sealey R., "How to Keep Your Volkswagen Alive", John Muir Publication, Santa Fe, New Mexico ©1980, p. 113.

*Primary Examiner*—Michael R. Lusignan
*Assistant Examiner*—Richard Bueker
*Attorney, Agent, or Firm*—Lester H. Birnbaum

[57] ABSTRACT

Disclosed is a method of improving the coating on electrodes (11 and 12) in spark gap devices which minimizes filament formation, densifies the coating, and ensures a good bond between the coating and underlying electrode. The device is coupled to a circuit (FIG. 2) which includes appropriate components so that a rapid sequence of current pulses having large amplitudes during arc initiation is passed through the device. The coating bonds with a different area of the cathode for each current pulse. The signal may be applied with appropriate reversal of polarities so that essentially the entire surface of both electrodes is thus reacted. Subsequently, the device may be subjected to an additional pulse in order to leave asperities on the surface which will increase field emission and ensure a low surge limiting voltage.

9 Claims, 6 Drawing Figures

PROCESS FOR IMPROVING ELECTRODE COATINGS

BACKGROUND OF THE INVENTION

This invention relates to improving coated electrode surfaces, and in particular to a method useful in surge limiters to minimize filament formation and ensure a good bond between the coating and electrode over essentially the entire interface.

Surge limiters are primarily used to protect apparatus from high voltage surges resulting from a variety of causes, such as lightning strikes. The devices basically comprise a pair of electrodes with a spark gap therebetween. The device is coupled in parallel with the protected apparatus and does not interfere with the functioning of the apparatus since the device is nonconducting during normal operation. However, when a voltage surge of sufficient magnitude appears at the electrodes, a spark is produced across the gap, and the surge is shunted from the apparatus. In a sealed gas surge limiter, the electrodes are placed in a hermetically sealed housing which includes a suitable gas. The device fires when the gas in the gap area is sufficiently ionized to produce a spark.

It has been recognized that a coating of graphite on the surface of the electrodes will improve device performance by increasing electron emission and thereby enhancing plasma discharge in the gap. However, a device with the as-deposited, unbonded carbon has a relatively short life. Also, in a narrow gap device carbon filaments tend to form on the surfaces of the electrodes after a few discharges of the device, and this effect results in leakage currents and could produce short circuits in some cases.

It has also been recognized that the bond between the coating and electrode could be improved by applying to the electrode a signal which causes conduction in the arc mode for several short periods of time. It was discovered that under the appropriate conditions, the spark would "dance" around the surface of the electrodes, causing a different portion of the coating to bond with the cathode during each conduction period. It was therefore suggested that a pulsed signal be applied to the electrodes with appropriate reversal of polarities until the entire surface of both electrodes was bonded (see U.S. patent application of P. Zuk, Case 14, filed on an even date herewith and assigned to the same assignee, which is incorporated by reference herein).

In a commercial environment, for long life, it is desirable to optimize this process by ensuring a uniform and complete reaction of both electrode surfaces within a reasonable time. At the same time, if the surface of the electrodes is too smooth, devices have a tendency to exhibit high surge limiting voltages. It is therefore also desirable to leave some asperities on the electrode surfaces to increase field emission and thereby ensure a low surge limiting voltage.

SUMMARY OF THE INVENTION

These and other objects are achieved in accordance with the invention which is a method of fabricating a device having two electrodes with coatings thereon and a spark gap defined therebetween, and the resulting product. A pulsed signal is applied to the electrodes by means of a circuit which causes conduction of a rapid sequence of current spikes having high amplitudes through the electrodes. These current spikes are such as to cause a different portion of the coating to bond with the electrode in a random fashion for each conduction and to cause the coating to bond over essentially the entire interface with the electrodes. If desired, a further pulse may then be applied to form some asperities on the surface to increase field emission and provide a low surge limiting voltage.

BRIEF DESCRIPTION OF THE DRAWINGS

These and other features of the invention are delineated in detail in the following description. In the drawings.

It will be appreciated that for purposes of illustration, these figures are not necessarily drawn to scale.

DETAILED DESCRIPTION

Figure 1:
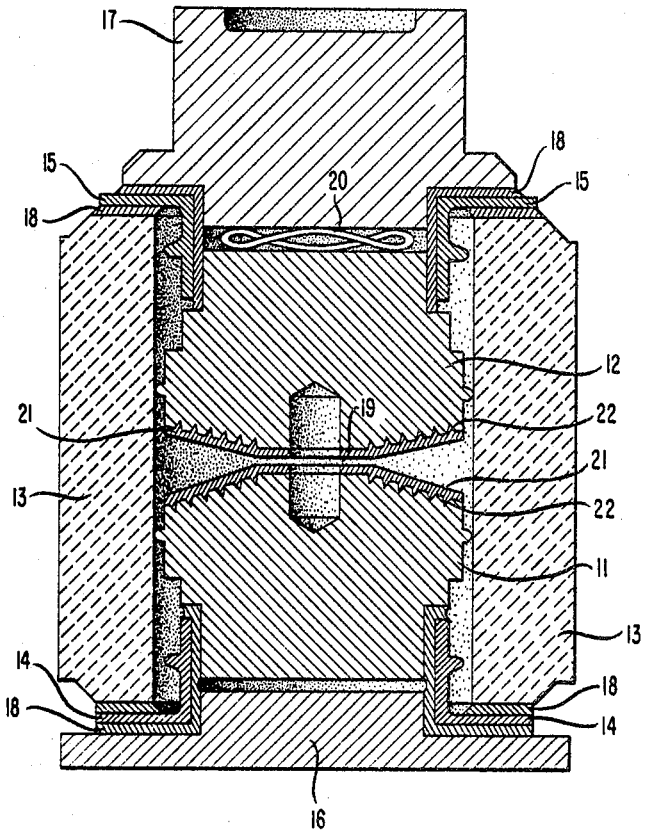
FIG. 1 is a cross-sectional view of a typical sealed gas surge limiter fabricated in accordance with one embodiment of the invention.

The invention will be described with reference to the fabrication of a typical sealed gas surge limiter illustrated in FIG. 1. The device includes two electrodes, 11 and 12, defining a narrow spark gap, 19, therebetween. The electrodes were bonded to flanges, 14 and 15, which were in turn bonded to opposite ends of an insulating housing, 13. Also bonded to the flanges and electrically coupled to the electrodes were terminals, 16 and 17. The housing was filled with argon gas and hermetically sealed, utilizing a fusible metal 18 for all bonding between electrodes, flanges, terminals, and the insulating housing. A spring, 20, was included between electrode 12 and terminal 17 to aid in achieving a uniform gap.

In this particular device, a narrow gap of approximately 67 μm was formed between the flat surfaces of the electrodes. (The sloped portions usually extend to approximately 200 μm apart.) Such a narrow gap results in a device which will fail in a closed circuit condition if a leak develops, and failures can therefore be detected and faulty devices replaced without danger to the protected apparatus. To achieve this, a gap of less than 75 μm is desirable. (For more details on the structure of such devices, see U.S. Pat. No. 4,175,277 issued to Zuk.)

In this example, the electrodes were made of copper and included a coating, 21, of carbon (graphite) on the portion of the electrode surfaces which face each other. The coating was treated in accordance with the method of the invention described below. The electrode surfaces also included grooves, 22, to inhibit deterioration of the carbon coating. (See, for example, U.S. Pat. No. 4,037,266 issued to English et al.). The insulating housing was made of ceramic, the flanges were made of copper, and the terminals comprised an iron-nickel alloy plated with nickel. The fusible metal was a silver-copper eutectic.

The carbon coating was formed on the electrode surface by first depositing the coating by a standard spraying of colloidal graphite (a suspension of graphite in alcohol and water). In this example, the coating was approximately 3μthick but will generally fall within the range 1.5–5μ. The device was then completely assembled according to standard fabrication techniques.

As disclosed in the Zuk application, previously cited, the bond between the coating and the underlying electrode is improved by subjecting the device to a signal which causes conduction in the arc mode for several short periods of time (preferably less than 200 μsec). The spark produced during each firing occurs at unreacted areas around the surface of the electrode to essentially cause a different portion of the coating to bond with the underlying electrode during each firing.

In order to improve the electrode coating, it has been found that the device should be subjected to a rapid sequence of current spikes each having a rapidly rising leading edge and a high amplitude. During arc initiation (i.e., within the first 50 nanoseconds of the onset of discharge), such spikes cause extremely high current densities across the gap since, at least initially, there is a very narrow lateral extension of the arc. Each high density arc initiation causes a minute area of the coating to densify or the electrode surface to react with the coating. Because the arc spreads, the desired surface reaction is produced only during arc initiation and so a high amplitude during arc initiation is needed. Further, the current spikes should be sufficiently rapid so that the device fires several times before the plasma is completely extinguished. This results in reactions which are produced at random along the electrode surface since the locations will be determined by the drift of remnant charges from the previous discharge and not by surface conditions. Such a treatment produces a uniform reaction on at least the flat portions of the electrodes, which are the significant portions of the electrodes since they determine the value of the surge limiting voltage. The sloped portions are also reacted, but not as uniformly as the flat portions.

Figure 2:
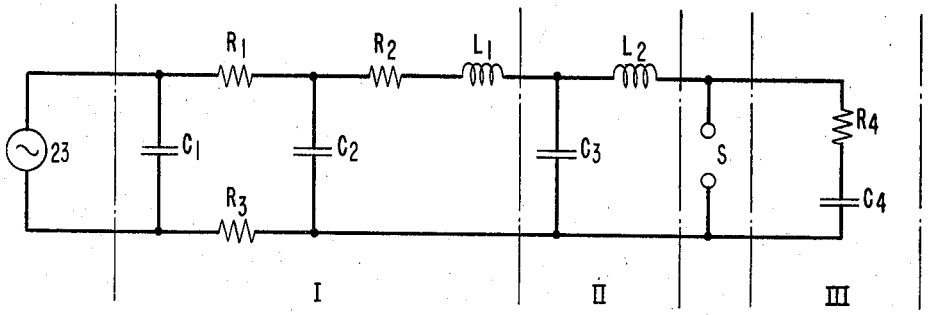
FIG. 2 is a circuit diagram of a circuit which is useful in applying a signal to the device during one fabrication step in accordance with the same embodiment.

In order to insure a proper degree of bonding of the surface in a short period of time, the completed device was therefore subjected to signals from the circuit illustrated in FIG. 2. In the circuit, the surge limiter is represented by S. Current was supplied by an AC signal source, 23, which produced a 60 cycle/second signal with a voltage of 1,000 volts RMS. For purposes of discussion, the remainder of the circuit is divided into portions I, II and III and their basic functions will be described for illustrative purposes and not by way of limitation.

Figure 3:
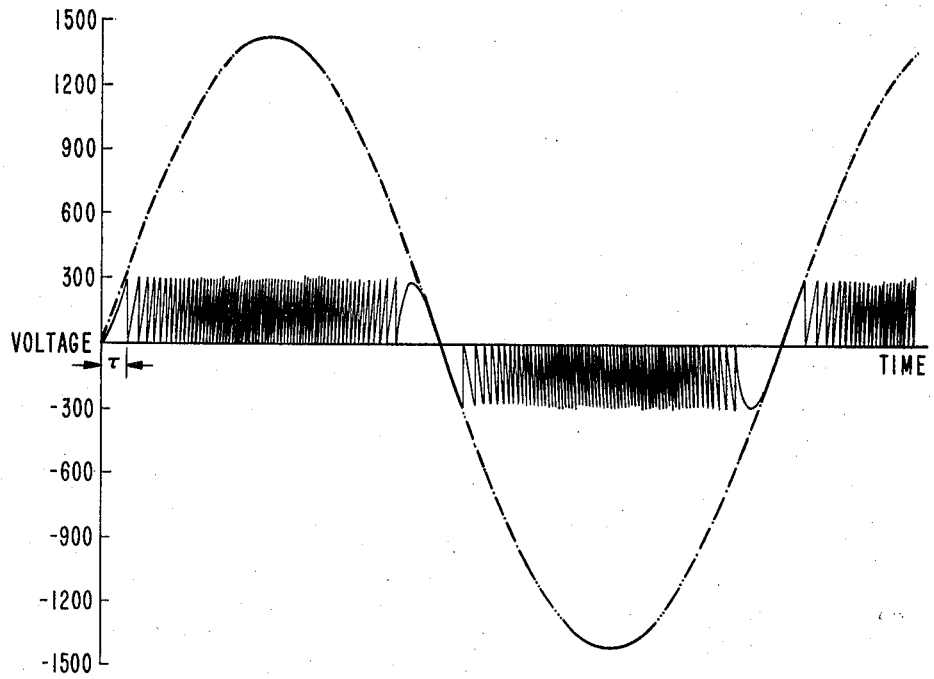
FIG. 3 is an illustration of the voltage across the device during the application of the signal from the circuit in FIG. 2.

Portion I included a series connection of resistors $R_1$ and $R_2$ and inductor $L_1$ between source 23 and one electrode of the limiter S, and a resistor $R_3$ between the other electrode of the limiter and the source 23. Coupled in a series discharge path to one end of resistors $R_1$ and $R_3$ was a capacitor $C_1$, and coupled to the other end of $R_1$ and $R_3$ in a series discharge path with $R_2$ and $L_1$ was a capacitor $C_2$. $R_1$, $R_3$, $C_2$ and the surge limiter, S, acted as a relaxation oscillator to produce a desired number of sawtooth voltage waveforms per half cycle of the applied 60 cycle voltage, in this case approximately 45–60. This is illustrated in the curve of FIG. 3 which shows the approximate voltage waveform across the device. The dashed curve represents the voltage supplied by source 23. As a result of this voltage, $C_2$ will charge at a rate determined by its capacitance as well as resistances $R_1$ and $R_3$. When the voltage across the limiter, S, reachs breakdown voltage, $V_B$, the capacitor $C_2$ will discharge. When the limiter turns off, $C_2$ will again charge and the process repeated. As shown in FIG. 3, the oscillation frequency will vary with the applied voltage. (Not all breakdowns are shown in the figure for the sake of clarity.) $C_1$ serves as a by-pass capacitor, $R_2$ limits the discharge current, and $L_1$ slows the discharge from $C_2$ to permit functioning of the other portions of the circuit several times for each period of oscillation. In this example, the period of oscillation, $\tau$, will vary with the voltage but will be greater than 80 microseconds.

Portion II of the circuit included a capacitor $C_3$ and inductor $L_2$ also in a series discharge path with the limiter S, with $C_3$ coupled between the two inductors $L_1$ and $L_2$. This portion forms a shocked resonant oscillator with S, the effect being to cause the limiter to turn off several times while $C_2$ is discharging. In fact, the circuit causes a slight voltage polarity reversal each time the device discharges to ensure turn off of the device. This happens because, on breakdown, $C_3$ will discharge through $L_2$ until the voltage across $C_3$ reverses. The oscillations of this portion are short-lived because the device will turn off after a half-cycle and the circuit will be loaded down by $R_4$ and $C_4$. However, the charging and discharging of $C_3$ will repeat several times while $C_2$ is discharging. Thus, the period of oscillation of this portion should be less than that of portion I to ensure multiple breakdowns of the limiter for each period $\tau$. In this example, the period of oscillation for $L_2$ and $C_3$ was calculated to be 0.38 microsecond. Interaction with the limiter and other circuit components actually resulted in periods which in general fell within the range 1–20 microseconds.

Portion III of the circuit included a resistor, $R_4$, and capacitor, $C_4$ in a series discharge path with the limiter. At each breakdown of the limiter, the capacitor discharges through the resistor a high current, in this example, approximately 30 amps. The response time of this portion (the time required for peak current from capacitor $C_4$ to be supplied to the limiter) should be very short to insure a very high current density across the gap of the limiter during arc initiation. In this example, the response time was less than 50 nanoseconds. The time constant for discharge of capacitor $C_4$ was approximately 0.05 μsec, but depending on the characteristics desired for the limiter, time constants up to 0.1 microsecond should generally be useful.

Figure 4:
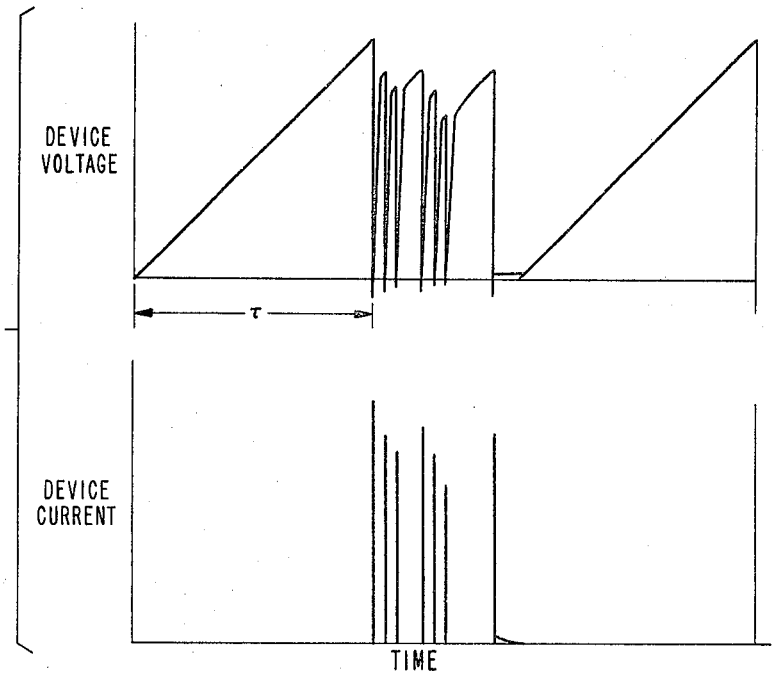
FIG. 4 is a more detailed view of the voltage across the device at the end of one period of oscillation, along with the current through the device at the end of the period, during the application of the signal from the circuit in FIG. 2.

FIG. 4 shows a more detailed view of a typical voltage across the device during one period of the relaxation oscillation shown in FIG. 3. Since the voltage waveform will vary from device to device and with the aging time, it should be appreciated that this waveform is shown for illustrative purposes only. It will be noted that the limiter typically breaks down several times at each sawtooth portion. This is caused by the action of portions II and III of the circuit as previously described. It will also be noted that there is a slight polarity reversal at each breakdown as previously described. FIG. 4 also illustrates typical current spikes through the device corresponding to the illustrative voltage. A current spike will occur each time the device breaks down. It is one aspect of the invention that the current spikes have a high amplitude at least during arc initiation and are produced in rapid sequence, in order to achieve a uniform reaction over the entire interface between the coating and flat portion of the electrode. The precise amplitude and frequency will vary with aging and from device to device. In general, current spike amplitude is limited by $R_4$ the value of which is determined by the desired limiter characteristics. Spike amplitudes should generally be in the range 10–1000 amperes, and current spikes during a period of oscillation should be less than 20 μsecs apart. In this example, the amplitude was 25–30 amperes and spikes were less than 10 μsecs apart.

In this particular example, the following circuit parameters were utilized (intrinsic parasitic inductances are included in parenthesis):

$R_1$=4k ohms (203 μH)

$R_2$=215 ohms (16 μH)

$R_3$=4k ohms (203 μH)

$R_4$=10 ohms $C_1$=500 pF $C_2$=0.03 μF $C_3$=1,000 pF $C_4$=5,000 pF $L_1$=27 μH $L_2$=3.6 μH It will be understood that these values are presented for purposes of illustration and can be varied according to particular needs.

The total time needed to apply the pulsed signal to the limiter can be determined by a visual inspection of the coating since the reacted area will be covered with contiguous spots. The time can also be determined empirically for each type of device by looking at the distribution of breakdown voltages and surge limiting voltages for groups of such devices aged at various times. If the time is too short, there will be a wide variation in these values, and if it is too long, the median surge limiting voltage will increase. In this example, the 60 cycle current source provided nine pulses with durations of 1 second each. In general, it is desirable in commercial production to subject the limiter to the pulsed signal for less than 10 seconds.

It is theorized that the high current density produced during initiation of the arc of the surge limiter (within 50 nanoseconds of the beginning of the discharge) causes the drive-in of the carbon coating and results in good bonding. Further, it takes several micro-seconds for the plasma produced in the area of the gap to be dissipated. By creating a rapid sequence of pulses, some ions will remain in the gap for the next succeeding discharge of the device. (This is evidenced by the fact that succeeding discharges occur at lower voltages as shown in FIG. 4.) It is believed that because some of these ions migrate between discharges, there is a greater tendency for subsequent discharges to be spread over the area of the electrode and a more uniform reaction over the surface of the electrode results. That is, the reactions will occur at random over the electrode surface and the locations will not be dependent upon surface properties. It should be noted that the precise mechanism is not well understood, and the above is presented only as a possible explanation of the results achieved.

It will be understood that the above reaction occurs at the negatively charged electrode (cathode). Thus, the reversal of polarity supplied by the AC source 23 allows both electrodes to be treated.

The above technique will create a uniformly bonded coating over at least the flat area of the electrodes. However, it is desirable in certain circumstances to leave some particles of the coating unbound and the electrode surfaces in a roughened condition. The unbound particles aid in producing surface asperities. Too few asperities, for example, may result in high surge limiting voltages (on the other hand, too much free carbon may result in low device resistance).

Figure 5:
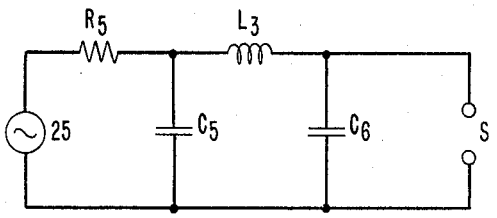
FIG. 5 is a circuit diagram of a circuit which is useful in applying a signal to the device during another fabrication step in accordance with an additional embodiment.
Figure 6:
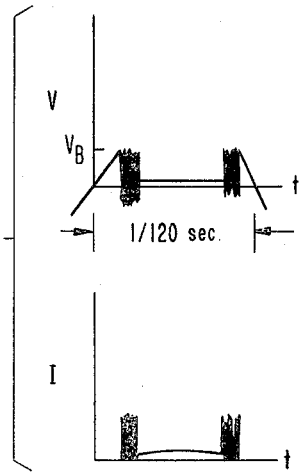
FIG. 6 is an illustration of the voltage across the device and the current through the device during the application of the signal from the circuit in FIG. 5.

In order to create the right amount of asperities, the device was then placed in the circuit shown in FIG. 5. Again, the surge limiter S is powered by an AC current source, 25, operating at 60 cycles per second and a voltage of 1,000 volts RMS. Coupled in series between the source and the device was a resistor $R_5$ and inductor $L_3$. Coupled in a series discharge path with the inductor and limiter was a capacitor $C_5$. Also coupled in parallel with the limiter at the other end of the inductor was another capacitor $C_6$. This circuit operates in a manner similar to that of FIG. 2 in that $R_5$, $C_5$ and the limiter form a relaxation oscillator, and the inductance of $L_3$ ensures that the device turns off. As is shown by the current and voltage waveform illustrations of FIG. 6, when the applied voltage exceeds breakdown, the device will discharge several times consistent with the relaxation oscillation, and current spikes will be conducted through the device. The magnitude of the spikes is determined by $C_6$, which is a stray capacitance. However, the resistor of the circuit, $R_5$, is chosen to be small enough so that when the voltage exceeds a certain value, there will be sufficient current to the limiter to sustain a nonoscillatory arc mode conduction for most of the period of the applied pulse. At the end of the pulse, as shown, the multiple discharges resume. The low current density through the limiter caused by this circuit produced the asperities for low surge limiting voltage. In this example, a single current pulse of approximately 1 amp rms was supplied for one second, and the period of nonoscillatory conduction extended for approximately 6.5 milliseconds per half cycle. In general, it is recommended that nonoscillatory conduction extend for periods of 5–7 milliseconds per half cycle to achieve the desired amount of asperities. The current amplitude of the applied pulse should preferably be within the range 0.5–1.5 ampere rms. In this particular example, the circuit parameters were as follows:

$R_5$=1k ohms $C_5$=1,000 pF $L_3$=27 μH $C_p \approx 100$ pF

Again, it will be appreciated that the circuit parameters may be varied for particular needs.

Sealed gas surge limiters fabricated in accordance with the above method generally exhibited device-to-device breakdown voltages which did not vary more than ±20 volts, and surge limiting voltages which did not vary more than ±125 volts from device-to-device. The devices were essentially free of filaments as indicated by standard resistance measurements (i.e., resistances greater than 100 megohms were measured). In addition, the median value of the surge limiting voltage was 535 volts, and no surge limiting voltage exceeded 640 volts. It is believed that these low values are at least in part due to the asperities left on the surface of the electrodes.

Various modifications of the invention will become apparent to those skilled in the art. All such variations which basically rely on the teachings through which the invention has advanced the art are properly considered within the spirit and scope of the invention.

What is claimed is:

1. A method of fabricating a sealed gas surge limiter having two electrodes (11 and 12) with a coating (21) on a portion of at least one electrode and a spark gap (19) between said electrodes comprising the step of applying a pulsed signal to the electrode by means of a circuit including an AC current source (23), first means (portion I) for causing a relaxation oscillation waveform across the electrodes throughout each half-cycle of the current, second means (portion II) for producing a plurality of current spikes through the electrodes at the end of each period of the relaxation oscillation waveform and to produce a small polarity reversal each time the waveform goes to zero, and third means (portion III) for producing current spikes of high amplitude, such that a limited portion of the coating bonds with the electrode for each conduction so that said coating is bonded over essentially the entire interface with the electrode.

2. The method according to claim 1 further comprising the step of applying a signal to the electrode by means of a second circuit which causes conduction of at least one current pulse through the electrodes sufficient to produce some asperities on the surface of the electrodes.

3. The method according to claim 1 wherein the amplitude of the spikes is within the range 10–1000 amperes.

4. The method according to claim 1 wherein the majority of current spikes is less than 20 μsecs from an adjacent spike.

5. The method according to claim 1 wherein the total time for applying the pulsed signal is less than 10 seconds.

6. The method according to claim 1 wherein the first means includes a first resistor ($R_1$) coupled in series between the current source and one electrode of the device, a second resistor ($R_3$) coupled in series between the current source and the other electrode of the device, first and second capacitors ($C_1$ and $C_2$) coupled in parallel to one end of both of said resistors, and a third resistor ($R_2$) and first inductor ($L_1$) coupled in a series discharge path between the second capacitor and one of the electrodes of the device.

7. The method according to claim 1 wherein the second means includes a second inductor ($L_2$) and a third capacitor ($C_3$) coupled in a series discharge path with the device.

8. The method according to claim 1 wherein the third means includes a fourth resistor ($R_4$) and fourth capacitor ($C_4$) coupled in series with each other and in a series discharge path with the device.

9. A method for fabricating a sealed gas surge limiter having two electrodes (11 and 12) with flat and sloped portions and with a coating (21) on the facing portions of the electrodes and a spark gap (19) between the flat portions of less than 75 μm comprising the steps of: applying a pulsed signal to the electrodes by means of a first circuit which includes an AC current source, first means (portion I) for causing a sawtooth voltage waveform across the electrodes throughout each half-cycle of the current, second means (portion II) for producing a plurality of current spikes through the device at the end of each period of the sawtooth waveform so that the majority of the spikes are less than 10 μsecs from an adjacent spike and for producing a small polarity reversal when the waveform goes to zero, and third means (portion III) for producing amplitudes for the spikes of 10–1000 amperes, so that a different limited portion of the coating bonds with the electrode for each current spike, and the coating is bonded uniformly over the flat portions of the electrodes; and applying a signal to the device by means of a second circuit which causes conduction of at least one current pulse through the electrodes sufficient to produce some asperities on the surface of the electrodes.

* * * * *